United States Patent [19]

Zepkowski

[11] 4,357,036

[45] Nov. 2, 1982

[54] SKI MANEUVERING APPARATUS

[76] Inventor: John Zepkowski, R.D. 2, Canton, Pa. 17724

[21] Appl. No.: 184,758

[22] Filed: Sep. 8, 1980

[51] Int. Cl.[3] ..... A63C 11/00

[52] U.S. Cl. ..... 280/809; 280/12 AA; 280/16; 280/606; 280/817

[58] Field of Search ..... 280/809, 816, 817, 818, 280/606, 12 AA, 12 F, 12 H, 15, 16, 17, 21 R, 21 A

[56] References Cited

U.S. PATENT DOCUMENTS 1,313,502 8/1919 Pangborn ..... 280/12 H

FOREIGN PATENT DOCUMENTS 614927 12/1926 France ..... 280/16
803852 10/1936 France ..... 280/21 A
1265693 5/1961 France ..... 280/818
1578848 7/1969 France ..... 280/21 A

*Primary Examiner*—Richard A. Bertsch
*Assistant Examiner*—Donald W. Underwood

[57] ABSTRACT

An apparatus for attachment to skis to assist the user to learn basic maneuvers. A bracket is pivotally connected between the front ends of the skis in such a manner that the rear ends thereof can move inwardly and outwardly, and the skis can pivot about their longitudinal axes. A vertical pole is pivotally attached to each ski at a point between the front bracket and the boot retaining means. A connecting rod is pivotally connected between the poles.

6 Claims, 4 Drawing Figures

SKI MANEUVERING APPARATUS

BACKGROUND OF THE INVENTION

This invention relates to training apparatus for skis, and more particularly, to apparatus which can be attached to conventional skis to assist the user in making turns, in stopping, and in traversing a slope at an angle to the fall line.

The beginning skier must learn certain basics such as ski-to-ski spacing and the correct positioning of the skis in various maneuvers. Until the basics are learned, the beginner experiences falls and thereby is subjected to risk of injury.

It is therefore an object of the present invention to provide an apparatus for simplifying the learning of the basics of skiing.

Another object is to provide an apparatus for enabling a beginning skier to employ his hands to assist in the correct positioning of his skis in the performance of various maneuvers.

SUMMARY OF THE INVENTION

Briefly, the present invention relates to an apparatus for use with a pair of skis, the combination comprising the following elements. Brace means is connected between the front portions of the skis. This maintains a given distance between the connected points while permitting the rear portions of the skis to assume a position whereby the distance between them is equal to, less than or greater than the given distance. The brace means also permits the skis to pivot about their longitudinal axes. Means is provided on each ski for receiving and retaining the boot of a person using the same. A vertical pole is attached to each of the skis at a point between the boot retaining means and the front brace. A connecting rod is pivotally connected at each end thereof to the vertical poles.

DESCRIPTION OF THE PREFERRED EMBODIMENT

Figure 1:
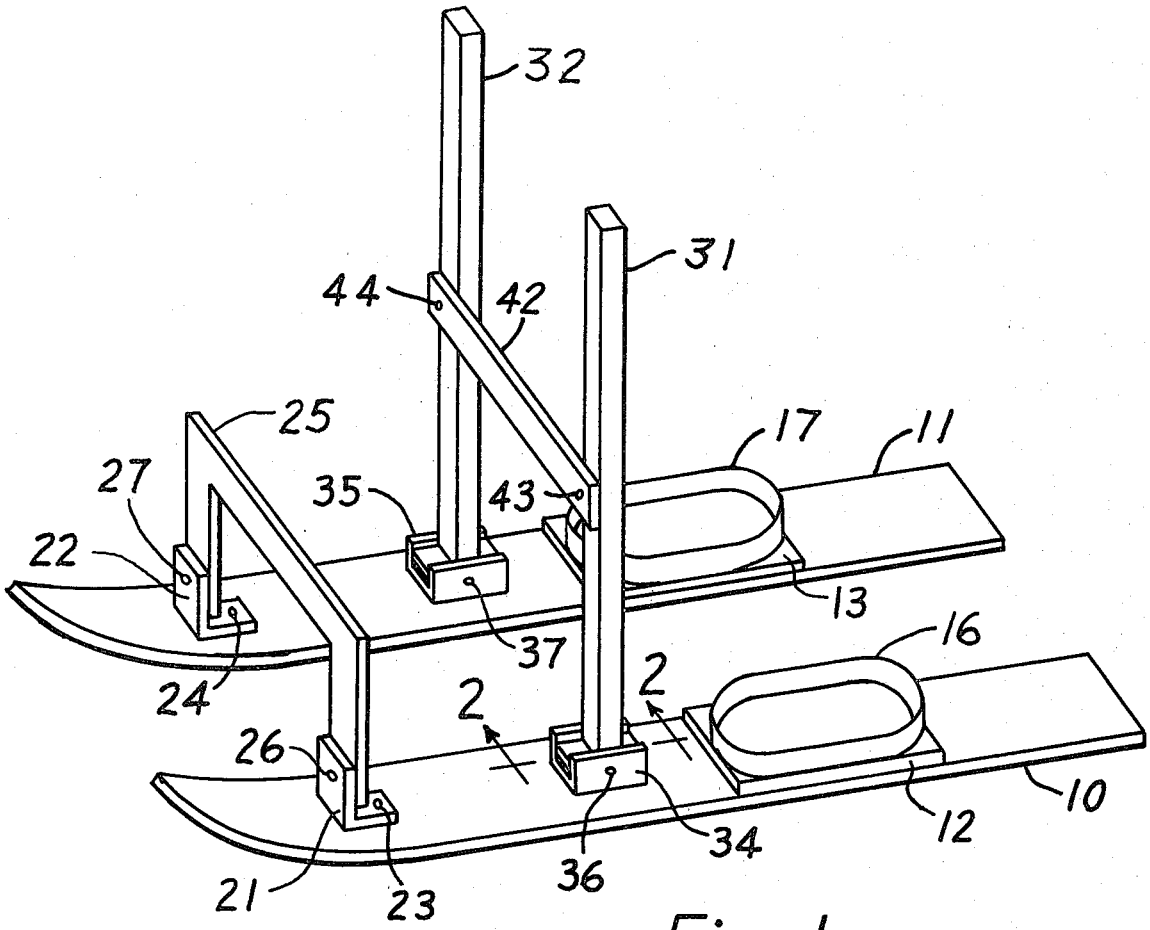
FIG. 1 is a oblique view of a pair of skis fitted with the apparatus of the present invention.

Referring to FIG. 1 there is shown a pair of skis 10 and 11 having raised portions 12 and 13 which contain means 16 and 17, respectively, for retaining a boot of the user. Although any conventional binding means such as safety release bindings may be utilized, there is illustrated a simple-to-use apparatus comprising ovular bands of plastic, metal or the like, which permits the user to quickly position his feet on the skis and to quickly disengage his feet in the event of a fall. A pair of such boot retainers of the size of the users boots could be affixed to the raised portions. Alternatively, a single pair of boot retainers could be employed, the length of which is adjustable.

A pair of L-shaped brackets 21 and 22 is located in the region of the skis where the tip begins to curve upward or somewhat to the rear of that region. Brackets 21 and 22 pivot about pins 23 and 24. A brace 25 is pivotally connected by pins 26 and 27 to brackets 21 and 22. It is preferred that brace 25 be bowed or U-shaped so that it does not strike small objects on the surface of the snow. The effect of pivot pins 23 and 24 is to permit the distance between the rear ends of the skis to vary. The skis are allowed to pivot about their longitudinal axes due to the presence of pins 26 and 27.

Figure 2:
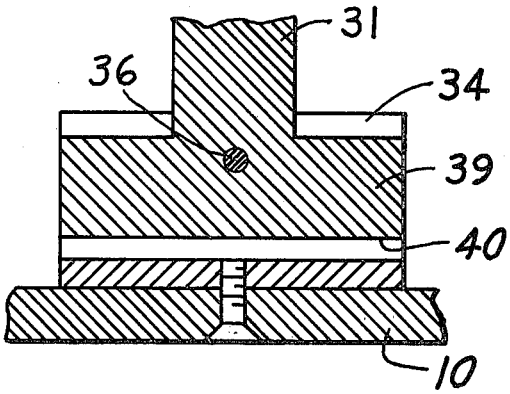
FIG. 2 is a cross-sectional view taken along lines 2—2 of FIG. 1.
Figure 4:
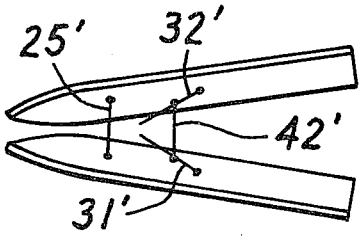
FIG. 4 is a schematic illustration of one of the possible ski maneuvers that can be made with the assistance of the apparatus of the present invention.

Two poles 31 and 32 are connected to skis 10 and 11, respectively, by brackets 34 and 35 which are mounted on that region of the skis between the boot retainers and brackets 21 and 22. The poles are sufficiently long that one using the apparatus can comfortably grip the upper ends thereof. The poles can be provided with hand grips and/or wrist straps if desired. As shown in FIG. 2 each of the brackets 34 and 35 may comprise a U-channel, the bottom of which is affixed by bolts or the like to the ski. Pivot pins 36 and 37 connect poles 31 and 32 to the upright walls of the brackets. The bottom of each pole has a flanged end 39. When pole 31 is moved to its maximum forward or maximum rearward position, the bottom surface 40 of end 39 butts against the bottom of bracket 34. Linkage rod 42 is pivotally connected to poles 31 and 32 by pins 43 and 44. Either one or both of the poles can be laterally deflected to either side to cause the ski connected thereto to pivot about is longitudinal axis so that the bottom thereof is no longer parallel to the surface of the snow.

Figure 3:
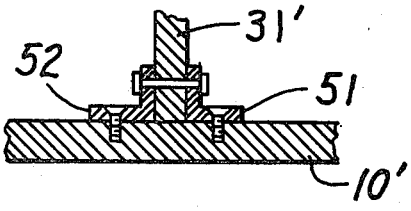
FIG. 3 is a cross-sectional view of a modification of the embodiment of FIG. 1.

In FIG. 3, wherein elements similar to those of FIG. 1 are illustrated by primed reference numerals, the poles are rigidly connected to the skis. Pole 31' is bolted to two L-shaped brackets 51 and 52 which are affixed to ski 10' by means such as bolts.

The training apparatus of the present invention operates as follows. When skiing down a slope, one can slow down by pushing the tops of poles 31 and 32 toward each other. This causes the skis to pivot about pins 23 and 24 so that the rear portions thereof become separated, and the inner edges bite into the snow. This position, referred to as the snow plow position, is illustrated schematically in FIG. 3 wherein elements corresponding to those of FIG. 1 are represented by primed reference numerals. Also, turn will occur when the skier shifts his weight to the ski that is opposite to the direction of the turn. Turning can also be accomplished by moving the pole that is opposite the direction of the turn toward the opposite pole. For example, one can turn to the left by moving the right pole to the left and shifting the weight to the right ski. When traversing a slope at an angle to the fall line, the downhill handle can be moved toward the other pole or handle which itlelf is maintained in an upright position. This maneuver should prevent side slipping. During the use of this apparatus, the skier may want to shift his weight forward or backward. This action is facilitated by the manner in which poles 31 and 32 are attached to the skis in the embodiment of FIGS. 1 and 2. This attachment permits the poles to move forward and backward a predetermined distance from the vertical position.

I claim:

1. An apparatus for use with a pair of skis, the combination comprising brace means connected between the front ends of said skis for maintaining a given distance between the connected points while permitting the rear portions of said skis to assume positions whereby the distance therebetween is equal to, greater than or less than said given distance and also permitting said skis to pivot about their longitudinal axes, means of each of said skis for retaining a foot of one skiing thereon, two vertical poles, each having a ski attachment end and a gripping end, the ski attachment end of each pole being attached to a respective one of said skis at a point between said means for retaining and the point of attachment of said brace means, and a linkage rod, each end of which is pivotally connected to one of said vertical poles, so that the rear portions of said skis become separated when said gripping ends of said two vertical poles are moved toward each other.

2. An apparatus in accordance with claim 1 wherein said brace means comprises two L-shaped brackets, each having a base that is pivotally connected to a respective one of said skis in such a manner that the base of said bracket remains parallel to the surface of the ski to which it is attached, and a brace pivotally connected at each end thereof to one of said brackets.

3. An apparatus in accordance with claim 2 wherein said poles are connected to said skis by pivot means for permitting said poles to move limited distances forward and backward.

4. An apparatus in accordance with claim 2 wherein said foot retaining means comprises a ribbon-shaped band arranged in an ovular shape, said band having a substantially constant height above the ski on which it is mounted.

5. An apparatus in accordance with claim 2 wherein the distance between said skis and the pivotal connection on said linkage rod is greater than the distance between said skis and the pivotal connections between said brace and said L-shaped brackets.

6. An apparatus for use with a pair of skis, the combination comprising brace means connected between the front ends of said skis for maintaining a given distance between the connected points while permitting the rear portions of said skis to assume positions whereby the distance therebetween is equal to, greater than or less than said given distance and also permitting said skis to pivot about their longitudinal axes, said brace means comprising two L-shaped brackets each having a base that is pivotally connected to a respective one of said skis, and a brace pivotally connected at each end thereof to one of said brackets, the central portion of said brace extending upwardly above said skis, means on each of said skis for retaining a foot of one skiing thereon, two vertical poles, an end of each being connected to a respective one of said skis at a point between said means for retaining and the point of attachment of said brace means, said poles being connected to said skis by pivot means for permitting said poles to move limited distances forward and backward, said pivot means comprising a bracket having a U-shaped cross-section, the bottom of each pole having a flanged end which is pivotally connected to the opposing walls of said bracket, the bottom surface of said flanged end contacting the bottom of said bracket when said pole moves predetermined distances forward or backward, and a linkage rod, each end of which is pivotally connected to one of said vertical poles.

* * * * *